US011131447B2

(12) United States Patent
Gui

(10) Patent No.: US 11,131,447 B2
(45) Date of Patent: Sep. 28, 2021

(54) LIGHTING FIXTURE

(71) Applicants: OPPLE LIGHTING CO., LTD., Shanghai (CN); SUZHOU OPPLE LIGHTING CO., LTD., Suzhou (CN)

(72) Inventor: Liangyin Gui, Shanghai (CN)

(73) Assignees: Opple Lighting Co., Ltd., Shanghai (CN); Suzhou Opple Lighting Co., Ltd., Suzhou (CN)

( * ) Notice: Subject to any disclaimer, the term of this patent is extended or adjusted under 35 U.S.C. 154(b) by 0 days.

(21) Appl. No.: 17/066,730

(22) Filed: Oct. 9, 2020

(65) Prior Publication Data

US 2021/0025575 A1 Jan. 28, 2021

Related U.S. Application Data

(63) Continuation of application No. PCT/CN2019/081795, filed on Apr. 8, 2019.

(30) Foreign Application Priority Data

Apr. 9, 2018 (CN) ..... 201820491637.9

(51) Int. Cl.
*F21V 21/088* (2006.01)
*F21V 19/00* (2006.01)
*F21V 23/06* (2006.01)

(52) U.S. Cl.
CPC ..... *F21V 21/088* (2013.01); *F21V 19/008* (2013.01); *F21V 23/06* (2013.01)

(58) Field of Classification Search
None
See application file for complete search history.

(56) References Cited

U.S. PATENT DOCUMENTS 6,632,100 B1 * 10/2003 Richardson ..... H01R 33/08 439/230
6,638,088 B1 * 10/2003 Richardson ..... F21V 19/008 439/242

(Continued)

FOREIGN PATENT DOCUMENTS

CN 203836644 U 9/2014
CN 104329602 A 2/2015

(Continued)

OTHER PUBLICATIONS

International Search Report of PCT Application No. PCT/CN2019/081795 dated Jul. 24, 2019, (4p).

*Primary Examiner* — Elmito Breval
(74) *Attorney, Agent, or Firm* — Arch & Lake LLP

(57) ABSTRACT

A lighting fixture includes a lighting tube and a light source assembly assembled in the lighting tube, and two end that respectively covers seal and block two ends of the lighting tube. Each of the two end covers is electrically connected with the light source assembly and an external element. The end cover includes a first connecting part and a second connecting part, the first connecting part is configured for achieving an electrical connection with the light source assembly and the external element; the second connecting part is sleeved outside the lighting tube and the first connecting part along a circumferential direction of the lighting tube, a periphery of the second connecting part is provided with a plurality of engaging parts, and the engaging parts are configured for achieving a mechanical connection with other lighting fixtures.

13 Claims, 10 Drawing Sheets

(56) References Cited

U.S. PATENT DOCUMENTS

| | | | | |
|---|---|---|---|---|
| 7,052,171 | B1 * | 5/2006 | Lefebvre | F21K 9/27 362/649 |
| 9,869,458 | B2 | 1/2018 | Li | |
| 10,851,951 | B2 * | 12/2020 | Wang | F21K 9/278 |
| 2010/0317212 | A1 * | 12/2010 | Daily | F21K 9/27 439/230 |
| 2012/0282815 | A1 * | 11/2012 | Aurongzeb | H01R 13/625 439/660 |

FOREIGN PATENT DOCUMENTS

| | | | |
|---|---|---|---|
| CN | 207935806 | U | 10/2018 |
| WO | 2017097846 | A1 | 6/2017 |

* cited by examiner

LIGHTING FIXTURE

CROSS-REFERENCE TO RELATED APPLICATIONS

This application is continuation of PCT patent application No. PCT/CN2019/081795 filed on Apr. 8, 2019 which claims priority to the Chinese patent application No. 201820491637.9 filed on Apr. 9, 2018, the entire content of all of which is hereby incorporated by reference herein for all purposes.

TECHNICAL FIELD

The present application relates to the field of lighting technology, in particular to a lighting fixture.

BACKGROUND

With the development of lighting technology, various lighting fixtures have been applied more and more widely in people's lives.

A lighting fixture usually includes a lighting tube and a light source assembly assembled in the lighting tube. Moreover, when applied, a lighting fixture in the art is usually used alone, and forms of application of the lighting fixture are relatively poor.

SUMMARY

In order to enrich the forms of application of the lighting fixture, the present application provides a lighting fixture.

A lighting fixture includes a lighting tube and a light source assembly assembled in the lighting tube. The lighting fixture further comprises an end cover, an amount of the end cover is two, the two end covers seal and block two ends of the lighting tube, respectively, and each of the two end covers is electrically connected with the light source assembly and an external element. Each of the two end covers comprises a first connecting part and a second connecting part, the first connecting part is configured for achieving an electrical connection with the light source assembly and the external element, the second connecting part is sleeved outside the lighting tube and the first connecting part along a circumferential direction of the lighting tube, a periphery of the second connecting part is provided with a plurality of engaging parts, and the plurality of engaging parts are configured for achieving a mechanical connection with other lighting fixtures.

BRIEF DESCRIPTION OF THE DRAWINGS

The drawings described here are used to provide a further understanding of the present application and constitute a part of the present application. The examples of the present application and the description thereof are used to explain the present application, and do not constitute an improper limitation to the present application, in the drawings.

REFERENCE SIGNS

1—lighting tube;

2—light source assembly; 21—light source substrate; 22—light-emitting unit;

3—end cover; **3*a*1—female connecting part; 3*a*11—plug-in groove; 3*a*12—female terminal; 3*a*2—male connecting part; 3*a*21—plug-in head; 3*a*22—male terminal; 3*a*23—terminal slot; 31—first connecting part; 311—first insulating body; 3111—first fixing block; 32—second connecting part; 321—groove portion; 322—convex portion; 323**—second fixing block;

4—fixing part; 41—connecting portion; 42—fixing portion; 421—fixing hole.

DETAILED DESCRIPTION

In order to make objects, technical solutions, and advantages of embodiments of the present application clearer, the technical solutions of the present application will be described in a clearly and fully understandable way in connection with the specific embodiments of the present application and corresponding drawings. It is apparent that the described embodiments are just a part but not all of the embodiments of the present application. Based on the embodiments of the present application, one of ordinary skill in the art can obtain other embodiment(s), without any creative work, which all shall be within the scope of the present application.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

The technical solutions provided by the preferred embodiments of the present application will be described in detail below with reference to the accompanying drawings.

As shown in FIGS. 1-4, an embodiment of the present application provides a lighting fixture, which includes a lighting tube 1, a light source assembly 2 assembled in the lighting tube 1, and an end cover 3 sealing and blocking both ends of the lighting tube 1.

Figure 4:
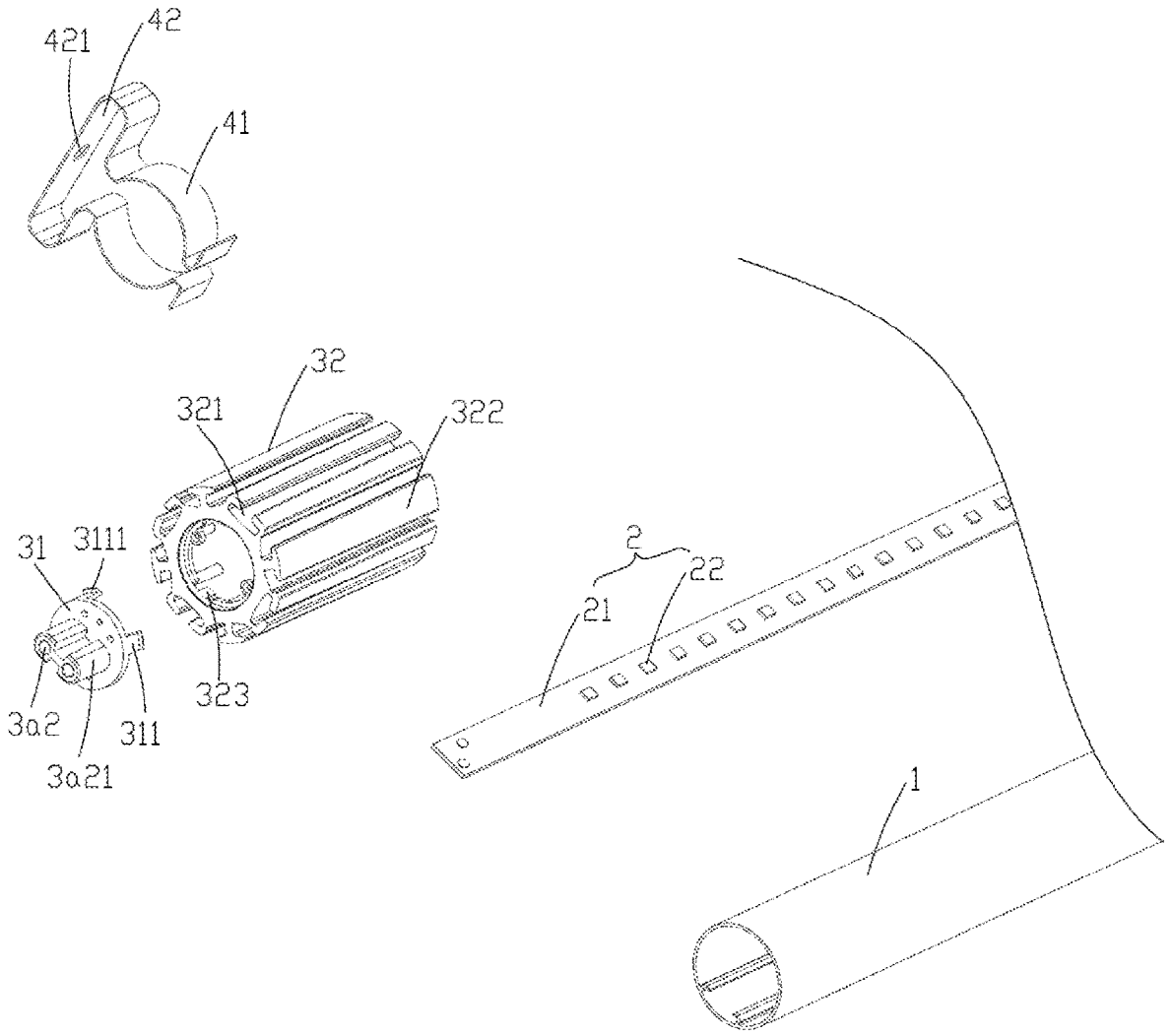
FIG. 4 is a partial exploded view of the lighting fixture as shown in FIG. 3.

The lighting tube 1 in one or more embodiments of the present application can be a T8 circular tube; of course, the model number and the shape of the lighting tube 1 can also be others, the present application does not limit them. Referring to FIG. 4, the light source assembly 2 includes a light source substrate 21 and a light-emitting unit 22 mounted on the light source substrate 21. The light-emitting unit 22 can adopt a LED light source, and can also adopt a light source of other types, of course.

The end cover 3 seals and blocks both ends of the lighting tube 1 and is electrically connected with the light source assembly 2 and an external element (e.g., an electrical connector for connecting to the mains supply or other lighting fixture(s)). At the same time, each end cover 3 includes a first connecting part 31 and a second connecting part 32. The first connecting part 31 includes a first insulating body 311 and a conductive terminal (not labelled) disposed on the first insulating body 311, so that the first connecting part 31 can achieve an electrical connection with the external element by the conductive terminal. The second connecting part 32 is sleeved outside the lighting tube 1 and the first connecting part 31 along a circumferential direction of the lighting tube 1. A periphery of the second connecting part 32 is provided with a plurality of engaging parts (not labeled), each of the engaging parts is configured for achieving a mechanical connection with another lighting fixture.

Each of the end covers of the lighting fixture of the present application includes a first connecting part 31 and a second connecting part 32. A periphery of the second connecting part 32 is provided with a plurality of engaging parts, each of the engaging parts is configured for achieving a mechanical connection with another lighting fixture, so that a plurality of lighting fixtures can be engaged with each other by the engaging parts disposed at the periphery of the second connecting part, which allows the present application to utilize a single lighting fixture alone and to splice a plurality of lighting fixtures together conveniently in various ways for use, thereby enriching the forms of application of the lighting fixture.

On the basis of splicing the lighting fixtures by the engaging parts at the periphery of the second connecting part 32, in order to further allow the plurality of lighting fixtures to be spliced together and hence be connected in series along an axial direction of the lighting tube 1 and to expand an illumination zone of the lighting fixture assembly, in the lighting fixture of an embodiment of the present invention, preferably, the first connecting parts 31 of the end covers 3 at two ends of the lighting tube 1 include connecting structures which can be engaged and connected with each other.

Figure 1:
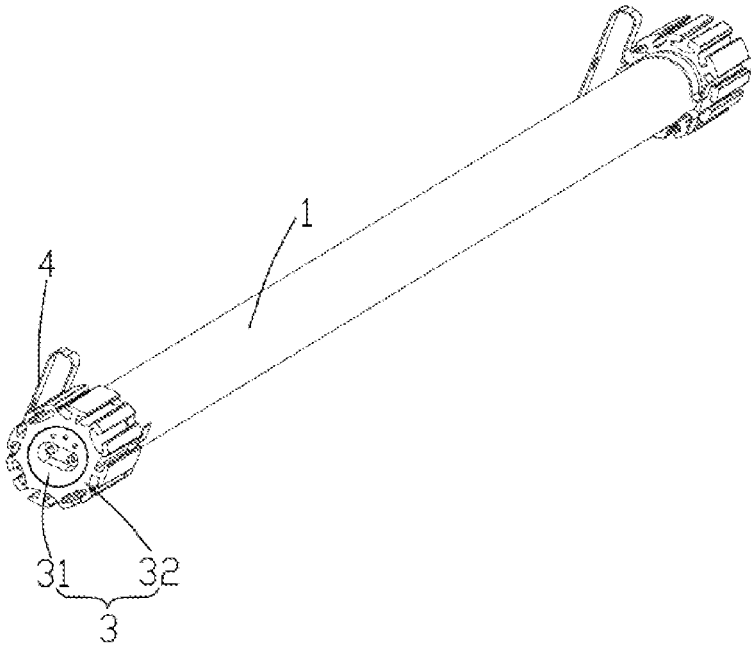
FIG. 1 is a perspective view of a lighting fixture in an example of the present application.
Figure 2:
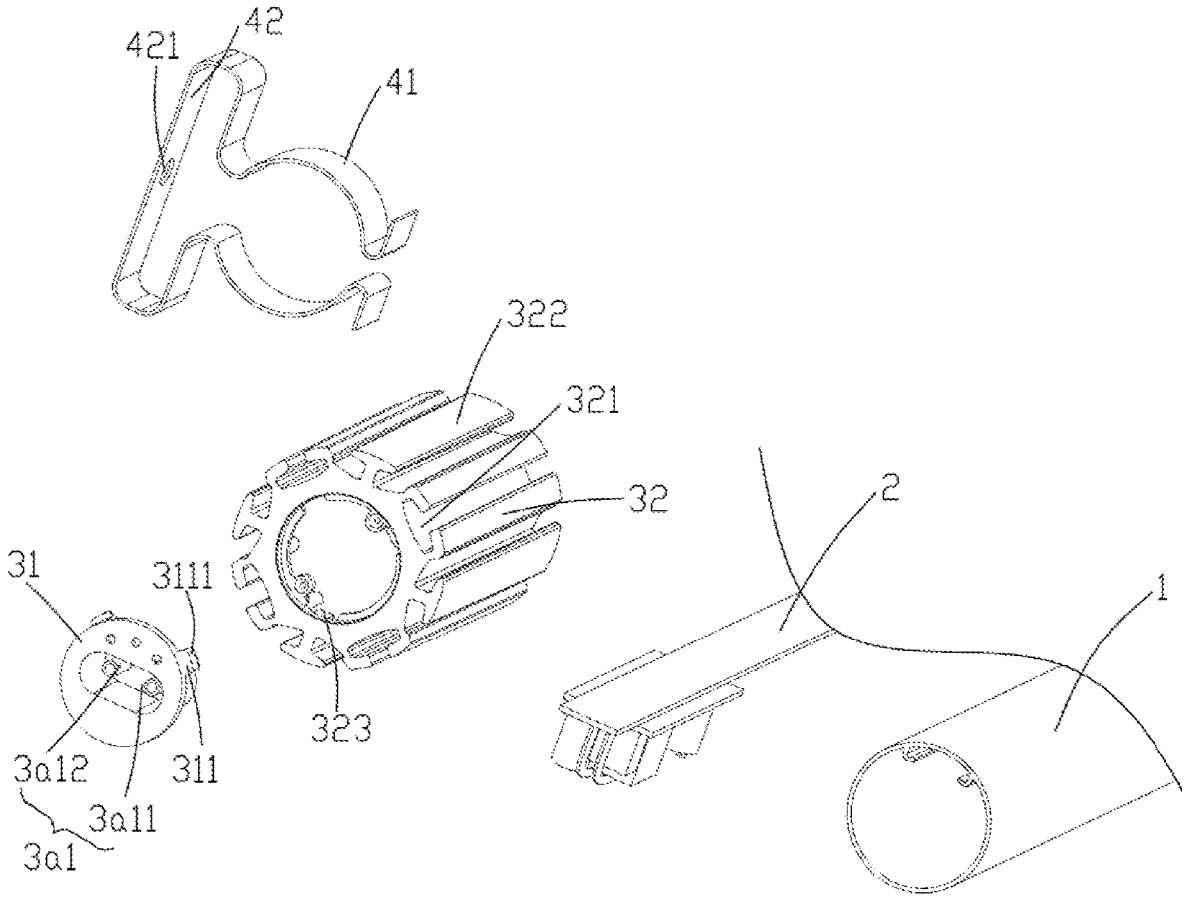
FIG. 2 is a partial exploded view of the lighting fixture as shown in FIG. 1.
Figure 3:
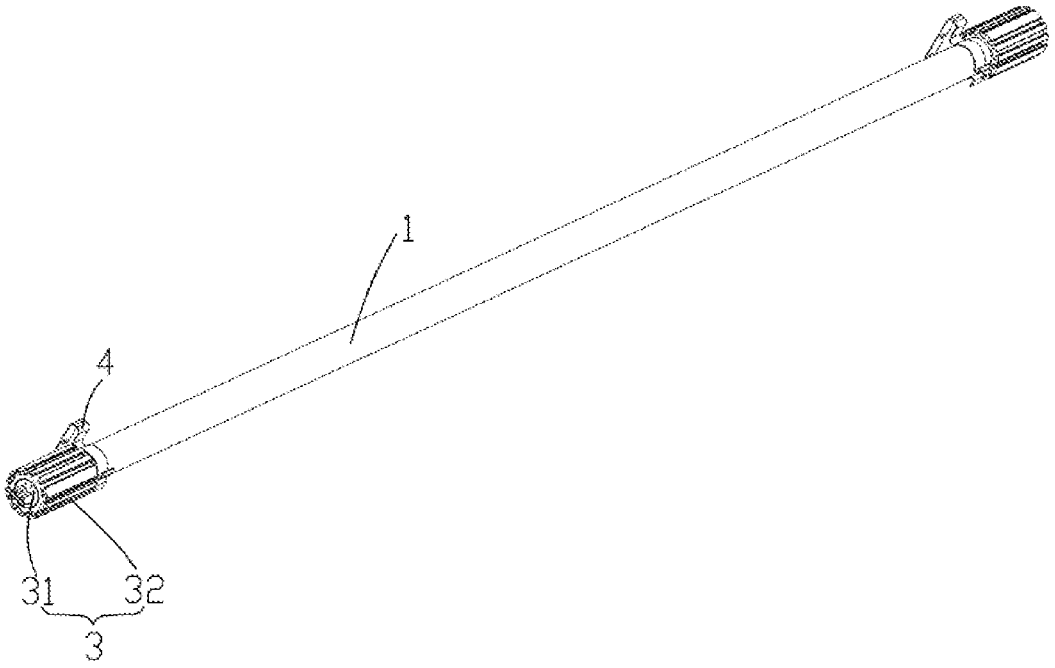
FIG. 3 is a perspective view of the light fixture as shown in FIG. 1 from another angle.

For example, as shown in FIG. 2, the first connecting part 31 at one end of the lighting tube 1 is a female connecting part **3*a*1, the female connecting part 3*a*1 includes a plug-in slot 3*a*11 (i.e., the connecting structure of the female connecting part 3*a*1) and a female terminal 3*a*12 (i.e., the conductive terminal of the female connecting part 3*a*1). The plug-in slot 3*a*11 is formed by depressing from an end face of the corresponding end cover 3 facing away from the lighting tube 1 towards the corresponding lighting tube 1 along the axial direction of the lighting tube 1. The plug-in slot 3*a*11 is formed by enclosing a slot wall (partial structure of the end cover 3). The female terminal 3*a*12 extends from the slot wall of the plug-in slot 3*a*11 along the axial direction of the lighting tube 1** and is exposed.

Figure 6:
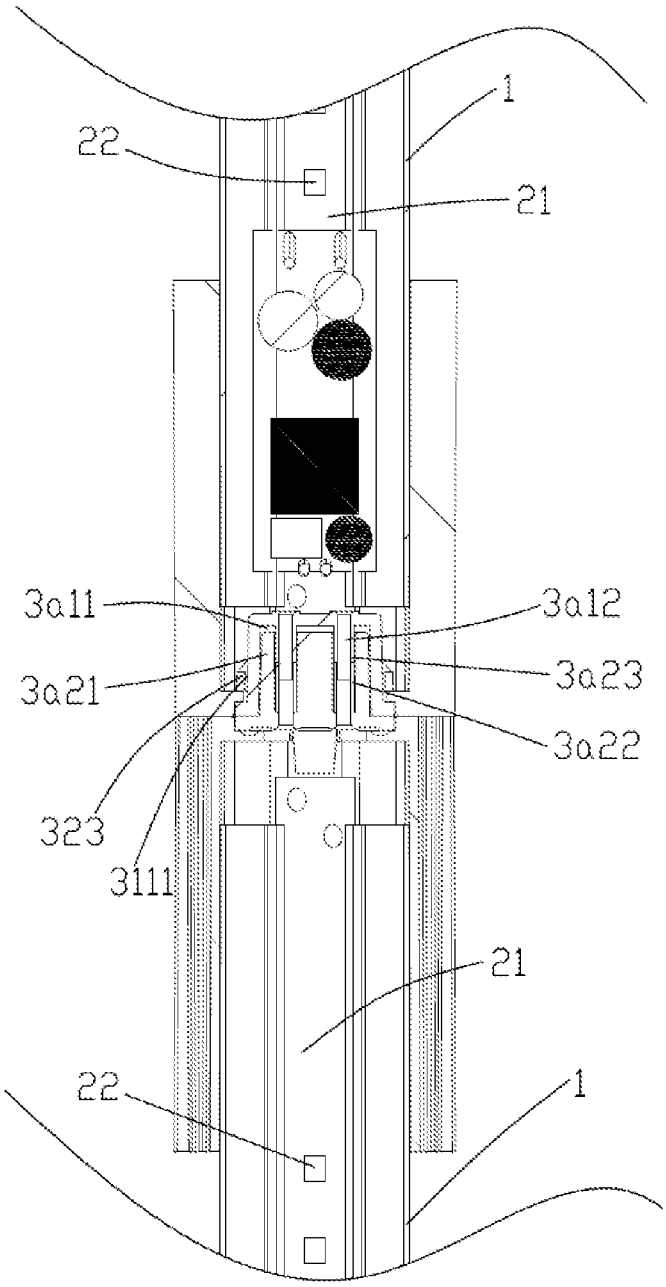
FIG. 6 is a cross-sectional view of a spliced position of adjacent two lighting fixtures as shown in FIG. 5.

As shown in FIG. 4, the first connecting part 31 at the other end of the lighting tube 1 is a male connecting part **3*a*2, the male connecting part 3*a*2 includes a plug-in head 3*a*21 (i.e., the connecting structure of the male connecting part 3*a*2) and a male terminal 3*a*22 (referring to FIG. 6, the male terminal 3*a*22 is the conductive terminal of the male connecting part 3*a*2). The plug-in head 3*a*21 is formed by protruding from an end face of the corresponding end cover 3 facing away from the lighting tube 1 along the axial direction of the lighting tube 1 in a direction facing away from the lighting tube 1. The plug-in head 3*a*21 is provided with a terminal slot 3*a*23 (referring to FIG. 6) which is depressed from a surface of the plug-in head 3*a*21 facing away from the lighting tube 1 towards the corresponding lighting tube 1 along the axial direction of the lighting tube 1; the male terminal 3*a*22 is plugged in the terminal slot 3*a*23**.

Figure 5:
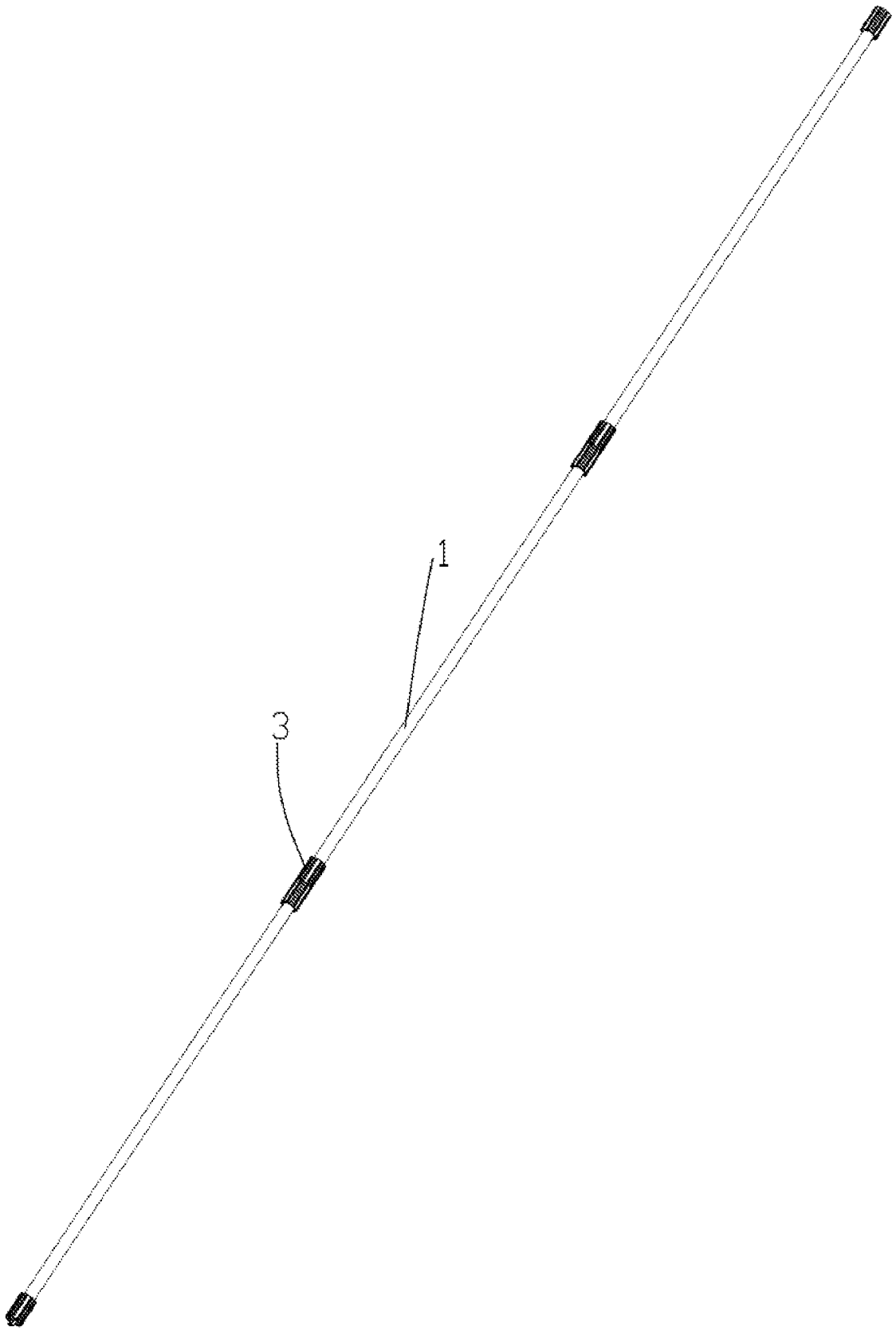
FIG. 5 is a spliced view of a plurality of lighting fixtures as shown in FIG. 1 along an axial direction of a lighting tube.

Referring to FIG. 5 and FIG. 6, the plug-in slot **3*a*11 and the plug-in head 3*a*21 can be matched and connected with each other in a plug-in manner, so that a plurality of lighting fixtures can be spliced together along the axial direction of the lighting tube 1 by an engagement between the plug-in slot 3*a*11 and the plug-in head 3*a*21 respectively on adjacent lighting fixtures. At the same time, when the plug-in slot 3*a*11 and the plug-in head 3*a*21 are connected in a plug-in manner, the corresponding female terminal 3*a*12 and male terminal 3*a*22 are in contact with each other and electrically connected with each other. For example, the female terminal 3*a*12 can be plugged in the male terminal 3*a*22**, so that two lighting fixtures adjacent in the axial direction can be electrically connected.

In addition to the first connecting part 31, the end covers 3 may further include a second connecting part 32 which is sleeved outside the first connecting part 31 along the axial direction of the lighting tube 1. The engaging part of the same second connecting part 32 can include a groove portion 321 and/or a convex portion 322. Alternatively, the engaging part of the same second connecting part 32 can only include a concave portion 321. Alternatively, the engaging part of the same second connecting part 32 can only include a convex portion 322. The groove portion 321 and the convex portion 322 can be engaged with each other in a clamped-in manner, so that two lighting fixtures can also be connected with each other by the second connecting parts 32 thereof.

In order to allow a plurality of lighting fixtures to be spliced regularly and orderly, in the present application, preferably, the groove portion 321 is depressed along a radial direction of the lighting tube 1 and extends along an axial direction of the lighting tube 1, and the convex portion 322 is protruded along the radial direction of the lighting tube 1 and extends along the axial direction of the lighting tube 12, but the present application is not limited thereto. Of course, the shape of the second connecting part 32 in the present application is not limited either, and it can be a quasi-cylindrical shape and can also be a quasi-cube shape or the like.

In order to allow the groove portion 321 and the convex portion 322 to be engaged with each other in a clamped-in manner conveniently, a cross section of each of the groove portion 321 and the convex portion 322 along the radial direction of the lighting tube 1 can be configured to have a "T" shape (the "T" shape here can be an irregular "T" shape, for example, the left side and the right side of the "T" shape are not necessarily symmetrical). A cross section of the groove portion 321 taken from a portion near the center of the end cover 3 to a portion away from the center of the end cover 3 along the radial direction of the lighting tube 1 has an inversed "T" shape, and a cross section of the convex portion 322 taken from a portion near the center of the end cover 3 to a portion away from the center of the end cover 3 along the radial direction of the lighting tube 1 has an upright "T" shape.

Figure 7:
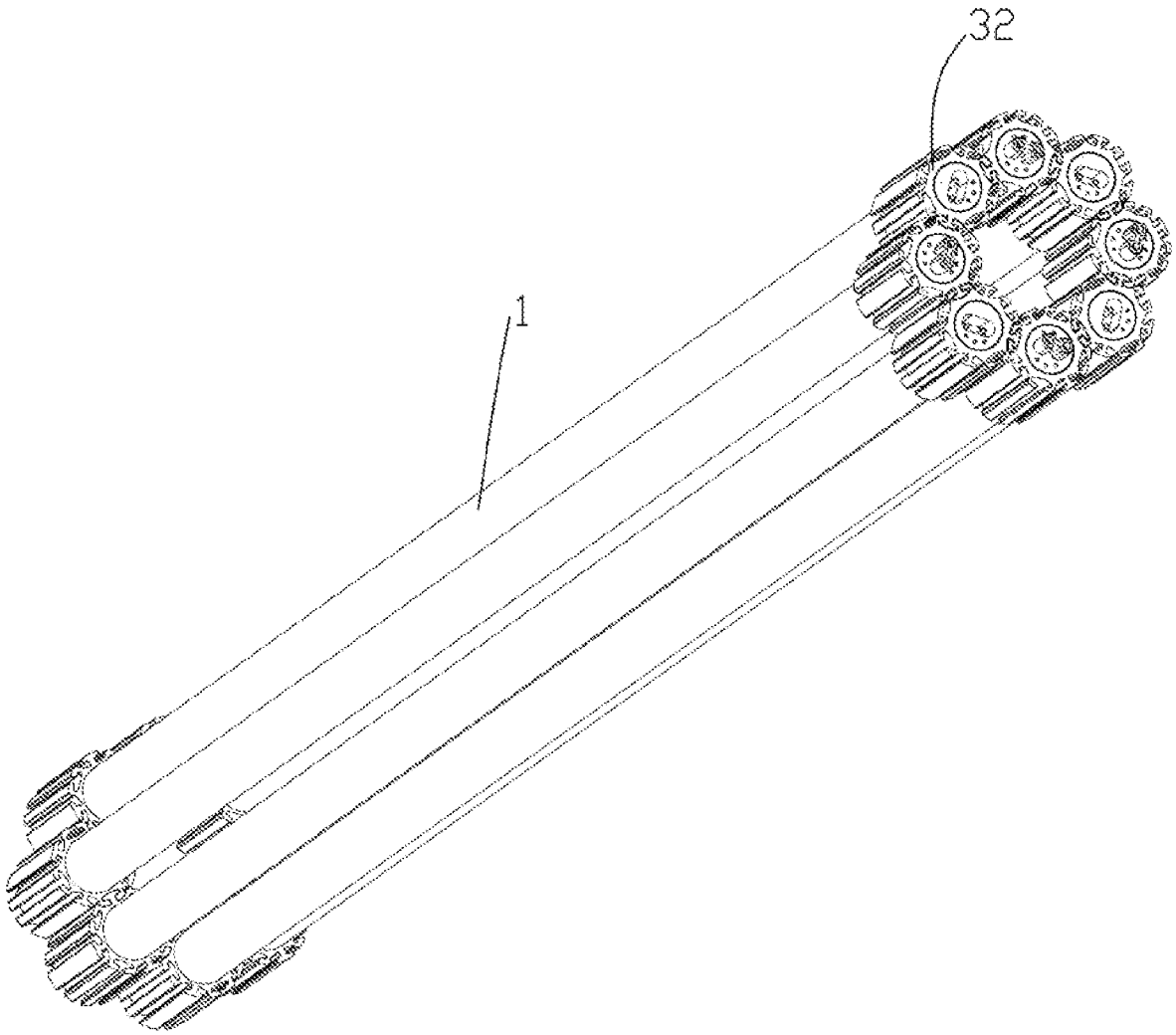
FIG. 7 is an annular-shaped spliced view of a plurality of lighting fixtures as shown in FIG. 1.
Figure 8:
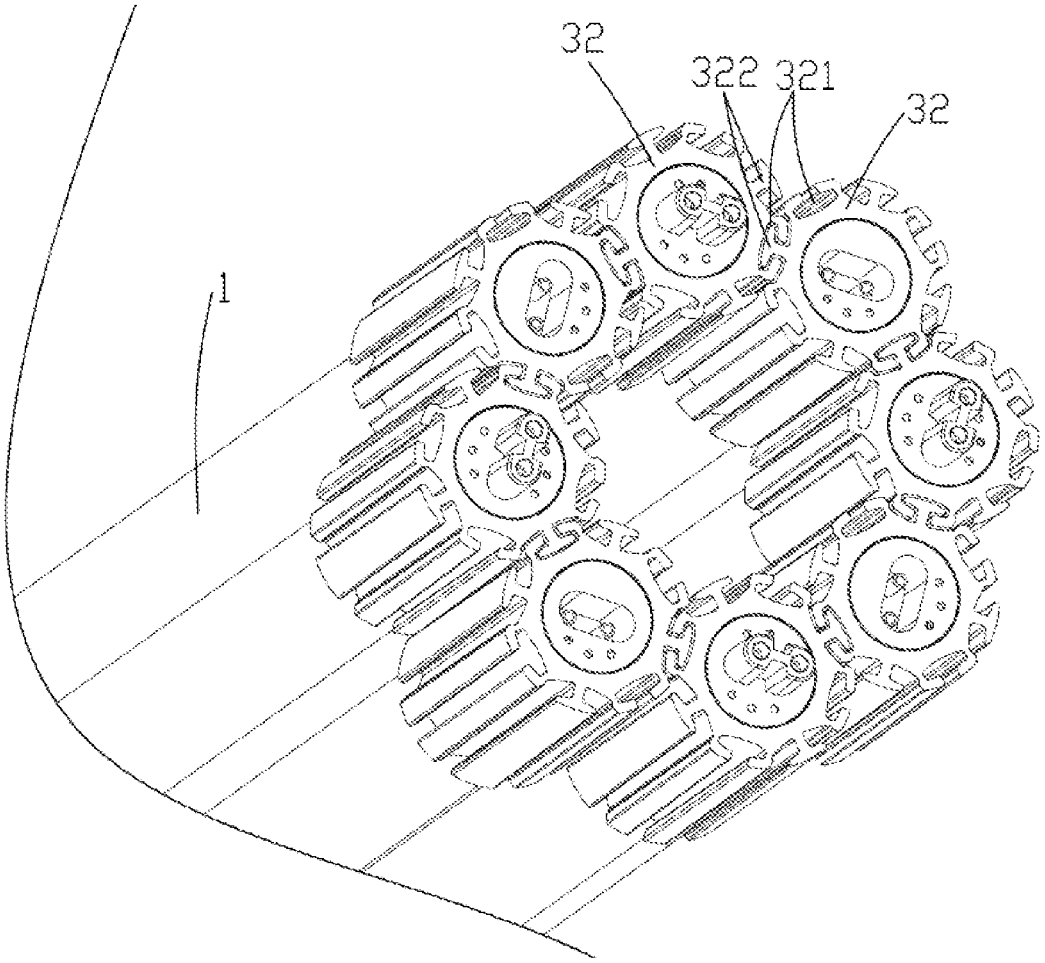
FIG. 8 is a partial enlarged view of the annular-shaped spliced view of the plurality of lighting fixtures as shown in FIG. 7.

Regarding the specific splicing manner, as illustrated in FIG. 7 and FIG. 8, in another embodiment of the present application, the same second connecting part 32 has a plurality of groove portions 321 and a plurality of convex portions 322; the plurality of groove portions 321 and the plurality of convex portions 322 are spaced apart from each other along a circumferential direction of the second connecting part 32, so that a plurality of lighting fixtures can be spliced with each other to constitute a circular ring with an attractive appearance.

Figure 9:
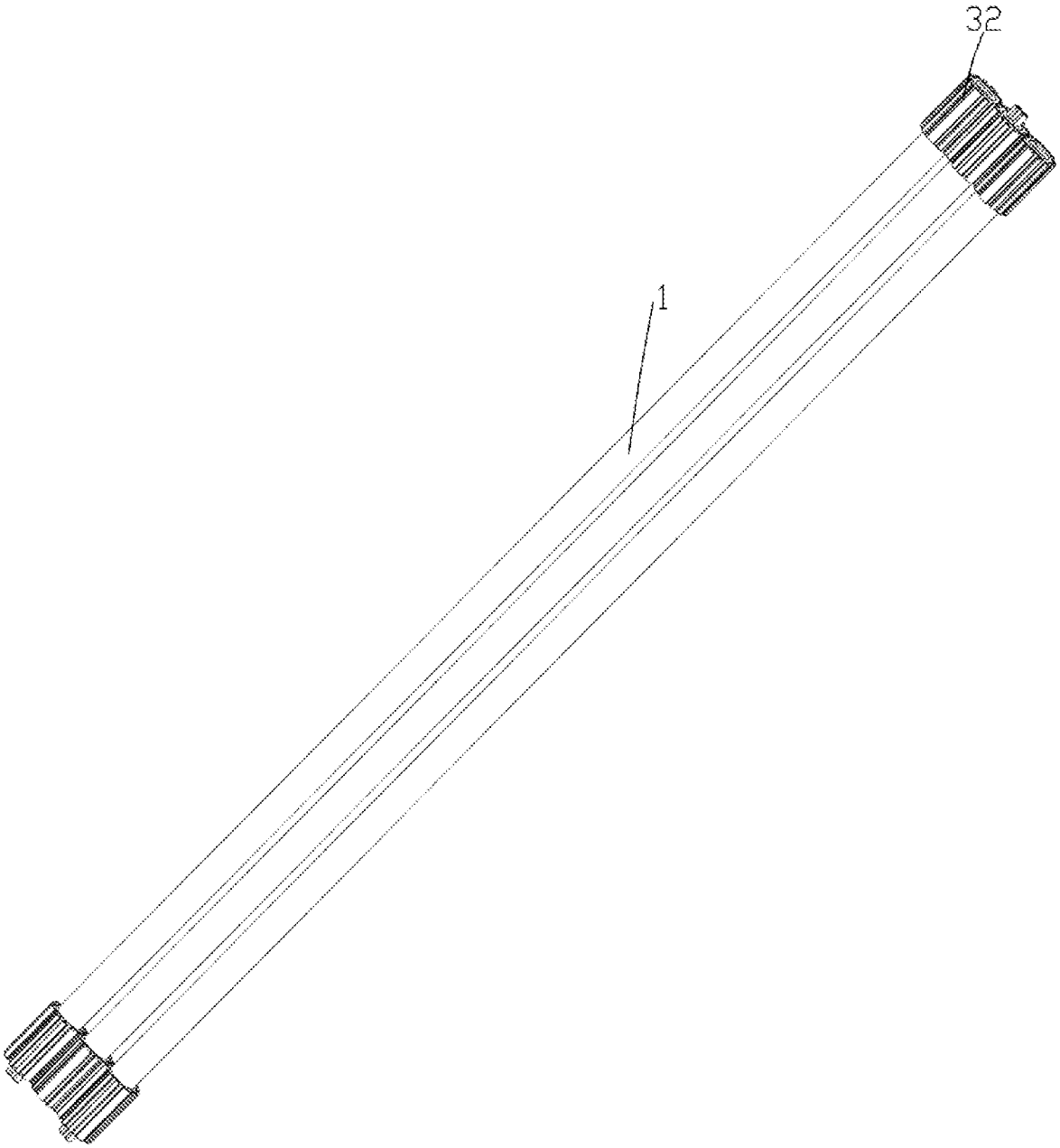
FIG. 9 is a spliced view of a plurality of lighting fixtures as shown in FIG. 1 along a radial direction of a lighting tube.
Figure 10:
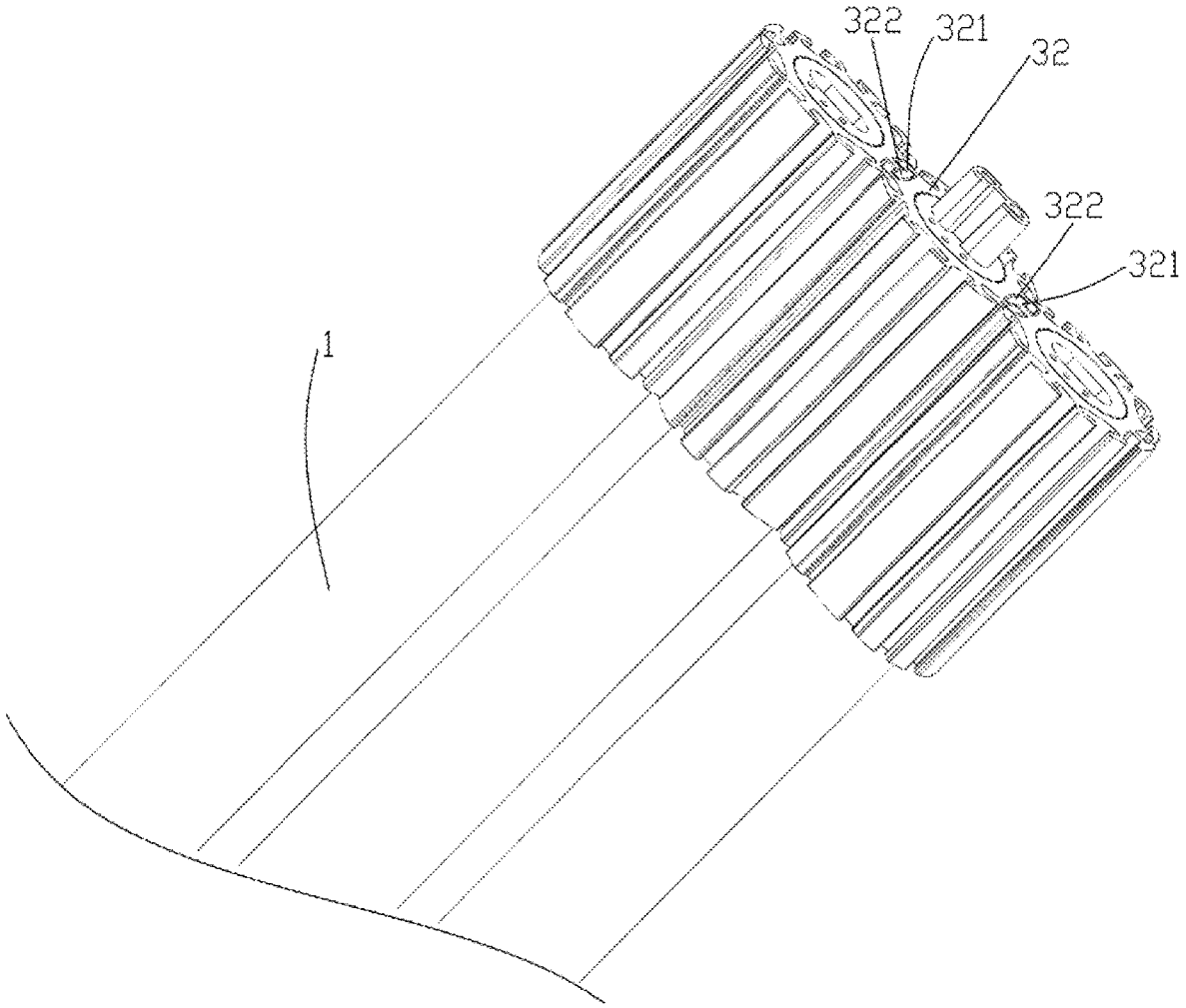
FIG. 10 is a partial enlarged view of the spliced view of the plurality of lighting fixtures along the radial direction of the lighting tube as shown in FIG. 1.

As shown in FIG. 9 and FIG. 10, in yet another embodiment of the present application, the same second connecting part 32 can also include, at least, one groove portion 321 and one convex portion 322 opposite to each other, so that a plurality of lighting fixtures can be spliced together along the radial direction of the lighting tube 1. Alternatively, the same second connecting part 32 can also include, at least, one pair of groove portions 321, and the two groove portions 321 are opposite to each other. Alternatively, the same second connecting part 32 can also include, at least, one pair of convex portions 322, and the two convex portions 322 are opposite to each other.

In one or more embodiments of the present application, by providing a plurality of groove portions 321 and a plurality of convex portions 322 on the second connecting part 32 of each of the lighting fixtures, the groove portions 321 of each of the lighting fixtures are engaged with the convex portions 322 of other lighting fixtures, respectively, so that a plurality of lighting fixtures can be spliced together in various ways depending on the demands to constitute a lighting fixture assembly in various shapes, which can enrich the forms of application of the lighting fixture.

In one or more embodiments of the present application, the second connecting part 32 and the first insulating body 311 of the first connecting part 31 can be separate structures so that the forming process is relatively simpler and easier to perform. At the same time, in order to allow the second connecting part 32 and the first connecting part 31 to be assembled together conveniently and quickly, in the present embodiment, the first insulating body 311 and the second connecting part 32 are connected with each other in a snap-fit manner. For example, referring to FIG. 2, FIG. 4 and FIG. 6, the first insulating body 311 of the first connecting part 31 is formed with a first fixing block 3111 thereon, the first fixing block 3111 is provided with a buckle, the second connecting part 32 is formed with a second fixing block 323, and the first fixing block 3111 and the second fixing block 323 are connected with each other in a snap-fit manner by the buckle, so that the first insulating body 311 and the first connecting part 31 are connected in a snap-fit manner. Of course, in some embodiments of the present application, the second connecting part 32 and the first insulating body 311 can also be formed integrally.

The lighting fixture can further include a fixing part 4, the fixing part 4 is sleeved at an outer surface of the lighting tube 1. The lighting fixture is fixed to a mounting base (e.g., a wall surface) by the fixing part 4. An embodiment of the present application recommends that the fixing part 4 is a fixing snap spring. Of course, the fixing part can also have other forms. The fixing part 4 includes a connecting portion 41 and a fixing portion 42 connected with the connecting portion 41. The connecting portion 41 can be movably sleeved at the outer surface of the lighting tube 1, so that the fixing part 4 can be assembled with and detached from the lighting tube 1 conveniently. The fixing portion 42 is formed with a fixing hole 421 therein, and the fixing hole 421 is configured to be cooperated with a connecting piece (not shown) so that the lighting fixture is stably and fixedly mounted at the mounting base.

Before a conventional lighting fixture is mounted, it needs to prepare a holder matched with the lighting tube 1, and a fixing hole would be formed at a position on the holder near an end of the holder. When the lighting fixture is mounting, firstly, the mounting base is punched to form two mounting holes corresponding to two fixing holes, then a connecting piece, such as screws, are passed through the two fixing holes and the corresponding two mounting holes respectively to mount the holder on the mounting base, finally the lighting fixture is clamped into the holder so that the lighting fixture is mounted on the mounting base. In the mounting manner described above, the fixing holes are located at two fixing positions of the holder and a distance between the two fixing holes is fixed, as a result, when the mounting base is punched to form the two mounting holes corresponding to the two fixing holes, it needs to precisely measure a relative position, which makes the mounting process complicated. In the lighting fixture of the embodiment of the present application, in order to mount the lighting fixture on the mounting base more firmly, it's also possible to provide two fixing holes 421. The specific arrangement manner can be as follows: two fixing parts 4 are provided, and each of the two fixing parts 4 is provided with one fixing hole 421. Because the connecting portion of the fixing part 4 is sleeved at the outer surface of the lighting tube 1, relative positions of the two fixing parts 4 can be properly adjusted conveniently, that is, a distance between the two fixing holes 421 can be properly adjusted conveniently, so that when the mounting base is punched, the requirements on the precision of the positions of the two mounting holes corresponding to the two fixing holes 421 can be considerably reduced, thereby effectively improving the mounting efficiency of the lighting fixture.

Alternatively or additionally, the engaging part of the same second connecting part comprises a groove portion and/or a convex portion, and the groove portion and the convex portion can be engaged with each other in a clamped-in manner.

Alternatively or additionally, the groove portion is depressed along a radial direction of the lighting tube and extends along an axial direction of the lighting tube, and the convex portion is protruded along the radial direction of the lighting tube and extends along the axial direction of the lighting tube.

Alternatively or additionally, the same second connecting part has a plurality of groove portions and a plurality of convex portions, the plurality of groove portions and the plurality of convex portions are spaced apart from each other along a circumferential direction of the second connecting part.

Alternatively or additionally, the same second connecting part at least has: one groove portion and one convex portion opposite to each other, or one pair of groove portions opposite to each other, or one pair of convex portions opposite to each other.

Alternatively or additionally, a cross section of the groove portion taken from a portion near a center of the end cover to a portion away from the center of the end cover along the radial direction of the lighting tube has an inversed "T" shape, a cross section of the convex portion taken from a portion near the center of the end cover to a portion away from the center of the end cover along the radial direction of the lighting tube has an upright "T" shape.

Alternatively or additionally, the lighting fixture further comprises a fixing part, the fixing part is sleeved at an outer surface of the lighting tube.

Alternatively or additionally, the fixing part comprises a connecting portion and a fixing portion connected with the connecting portion, the connecting portion is movably sleeved at the outer surface of the lighting tube.

Alternatively or additionally, the fixing portion is provided with a fixing hole.

Alternatively or additionally, an amount of the fixing part is two, and each of the two fixing parts is provided with one fixing hole.

Alternatively or additionally, the first connecting part at one end of the lighting tube is a female connecting part, the female connecting part comprises a plug-in slot and a female terminal, the plug-in slot is formed by depressing from an end face of the corresponding end cover facing away from the lighting tube towards the corresponding lighting tube along an axial direction of the lighting tube, the female terminal extends from a slot wall of the plug-in slot along the axial direction of the lighting tube and is exposed, the first connecting part at the other end of the lighting tube is a male connecting part, the male connecting part comprises a plug-in head and a male terminal, the plug-in head is formed by protruding from an end face of the corresponding end cover facing away from the lighting tube along the axial direction of the lighting tube in a direction facing away from the lighting tube, the plug-in head is provided with a terminal slot which is depressed from a surface of the plug-in head facing away from the lighting tube towards the corresponding lighting tube along the axial direction of the lighting tube; the male terminal is disposed in the terminal slot, the plug-in slot and the plug-in head can be matched with each other in a plugged-in manner, and when the plug-in slot and the plug-in head are connected with each other in the plugged-in manner, the female terminal and the male terminal are in contact with each other and are electrically connected with each other.

Alternatively or additionally, the first connecting part comprises a first insulating body and a conductive terminal disposed on the first insulating body, the second connecting part and the first insulating body are separate structures.

Alternatively or additionally, the first insulating body and the second connecting part are connected in a snap-fit manner.

Compared with the prior art, in the lighting fixture provided by the present application, the end cover includes a first connecting part and a second connecting part. A periphery of the second connecting part is provided with a plurality of engaging parts, the engaging parts are configured for achieving a mechanical connection with other lighting fixtures so that a plurality of lighting fixtures can be engaged with each other by the engaging parts disposed at the periphery of the second connecting part, thereby enriching the forms of application of the lighting fixture.

To sum up, in the lighting fixture provided by the present application, the end cover includes a first connecting part and a second connecting part. A periphery of the second connecting part is provided with a plurality of engaging parts, the engaging parts are configured for achieving a mechanical connection with other lighting fixtures so that a plurality of lighting fixtures can be engaged with each other by the engaging parts disposed at the periphery of the second connecting part, thereby enriching the forms of application of the lighting fixture.

The specific examples described above further describe the purpose, technical solutions and beneficial effects of the present application in further detail. It should be understood that the above are only specific embodiments of the present application and are not intended to limit the present application. Within the spirit and principle of the present application, any modification, equivalent replacement, improvement, etc., shall be included in the scope of the present application.

What is claimed is:

1. A lighting fixture, comprising:

a lighting tube;

a light source assembly assembled in the lighting tube; and two end covers that respectively seal and block two ends of the lighting tube, wherein each of the two end covers is electrically connected with the light source assembly and an external element, wherein each of the two end covers comprises: a first connecting part and a second connecting part, the first connecting part is configured for achieving an electrical connection with the light source assembly and the external element, the second connecting part is sleeved outside the lighting tube and the first connecting part along a circumferential direction of the lighting tube, a periphery of the second connecting part is provided with a plurality of engaging parts, each engaging part comprises a groove portion or a convex portion, and the plurality of engaging parts with the groove portion or the convex portion are configured to splice a plurality of lighting fixtures together.

2. The lighting fixture according to claim 1, wherein the groove portion and the convex portion of the engaging part are configured to engage with each other in a clamped-in manner.

3. The lighting fixture according to claim 2, wherein the groove portion is depressed along a radial direction of the lighting tube and extends along an axial direction of the lighting tube, and wherein the convex portion is protruded along the radial direction of the lighting tube and extends along the axial direction of the lighting tube.

4. The lighting fixture according to claim 3, wherein the second connecting part has a plurality of groove portions and a plurality of convex portions, the plurality of groove portions and the plurality of convex portions are spaced apart from each other along a circumferential direction of the second connecting part.

5. The lighting fixture according to claim 3, wherein the second connecting part comprises one of following structures:

one groove portion and one convex portion opposite to each other, one pair of groove portions opposite to each other, or one pair of convex portions opposite to each other.

6. The lighting fixture according to claim 3, wherein a cross section of the groove portion taken from a portion near a center of the end cover to a portion away from the center of the end cover along the radial direction of the lighting tube has an inversed "T" shape, a cross section of the convex portion taken from a portion near the center of the end cover to a portion away from the center of the end cover along the radial direction of the lighting tube has an upright "T" shape.

7. The lighting fixture according to claim 1, further comprising: a fixing part, wherein the fixing part is sleeved at an outer surface of the lighting tube.

8. The lighting fixture according to claim 7, wherein the fixing part comprises a connecting portion and a fixing portion connected with the connecting portion, the connecting portion is movably sleeved at the outer surface of the lighting tube.

9. The lighting fixture according to claim 8, wherein the fixing portion is provided with a fixing hole.

10. The lighting fixture according to claim 9, wherein an amount of the fixing part is two, and each of the two fixing parts is provided with one fixing hole.

11. The lighting fixture according to claim 1, wherein the first connecting part at one end of the lighting tube is a female connecting part, the female connecting part comprises a plug-in slot and a female terminal, the plug-in slot is formed by depressing from an end face of the corresponding end cover facing away from the lighting tube towards the corresponding lighting tube along an axial direction of the lighting tube, the female terminal extends from a slot wall of the plug-in slot along the axial direction of the lighting tube and is exposed, the first connecting part at the other end of the lighting tube is a male connecting part, the male connecting part comprises a plug-in head and a male terminal, the plug-in head is formed by protruding from an end face of the corresponding end cover facing away from the lighting tube along the axial direction of the lighting tube in a direction facing away from the lighting tube, the plug-in head is provided with a terminal slot which is depressed from a surface of the plug-in head facing away from the lighting tube towards the corresponding lighting tube along the axial direction of the lighting tube; the male terminal is disposed in the terminal slot, the plug-in slot and the plug-in head can be matched with each other in a plugged-in manner, and when the plug-in slot and the plug-in head are connected with each other in the plugged-in manner, the female terminal and the male terminal are in contact with each other and are electrically connected with each other.

12. The lighting fixture of claim 1, wherein the first connecting part comprises a first insulating body and a conductive terminal disposed on the first insulating body, the second connecting part and the first insulating body are separate structures.

13. The lighting fixture of claim 12, wherein the first insulating body and the second connecting part are connected in a snap-fit manner.

* * * * *